US005980327A

United States Patent [19]

Yen

[11] Patent Number: 5,980,327

[45] Date of Patent: Nov. 9, 1999

[54] MINIATURE LIGHT BULB SOCKET PREVENTING THE RUPTURE OF ELECTRICAL WIRES AT DEFLECTION POINTS

[76] Inventor: Chun Chang Yen, No. 8, Lane 247, Niu Pu Road, Hsinchu, Taiwan

[21] Appl. No.: 08/852,954

[22] Filed: May 8, 1997

[51] Int. Cl.[6] ..... H01R 17/00

[52] U.S. Cl. ..... 439/699.2; 439/602; 439/505

[58] Field of Search ..... 439/602, 699.2, 439/505, 457, 419, 619

[56] References Cited

U.S. PATENT DOCUMENTS 5,137,465 8/1992 Chwang ..... 439/699.2
5,620,343 4/1997 Pan ..... 439/602
5,848,916 12/1998 Huang ..... 439/457

*Primary Examiner*—Paula Bradley
*Assistant Examiner*—Katrina Davis
*Attorney, Agent, or Firm*—Rosenberg, Klein & Lee

[57] ABSTRACT

The present invention relates to a miniature light bulb socket featured by the capability of preventing the rupture of electrical wires at deflection points. The light bulb socket according to the invention has primarily two semi-circular grooves each formed on two opposed side walls thereof. The two grooves are located on such positions that enable the outwardly extending electrical wires to deflect at different points or levels when the wires bend towards two sides so as to avoid ruptures of electrical wires resulting from repeated reversal deflection at the same position. Therefore, the socket structure of the invention can prolong the service life of a miniature light bulb series and enhance the efficiency.

1 Claim, 3 Drawing Sheets

MINIATURE LIGHT BULB SOCKET PREVENTING THE RUPTURE OF ELECTRICAL WIRES AT DEFLECTION POINTS

BACKGROUND OF THE INVENTION

Generally a miniature type decorative light bulb series is made by serially connecting a plurality of small light bulbs with electrical wires that enter each light bulb socket from the lower end of the socket and conduct electrical currents to the light bulb via contact terminals. When a light bulb series is in use, it often requires to bend the connecting electrical wires toward one side or the other side depending on what the occasions it is used. As a result, after the electrical wires being bent a few times, they rupture at the deflection point, resulting in poor contacts. Hence, it is desirable to have an improved light bulb socket structure that can prevent the electrical wires from being broken.

In view of the above problem, the object of the present invention is to provide an innovative light bulb socket structure that can prevent electrical wires from being broken, prolonging the service life and enhancing the efficiency thereof. Now the detailed structure and features of the invention will be described below with reference to the accompanying drawings.

DETAILED DESCRIPTION OF PREFERRED EMBODIMENTS

Figure 1:
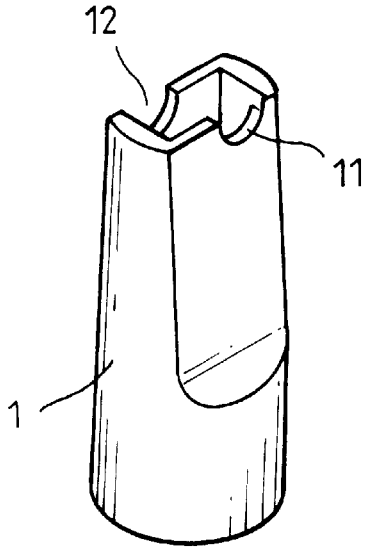
FIG. 1 is a perspective view showing the outer appearance of a light bulb socket according to this invention.
Figure 2:
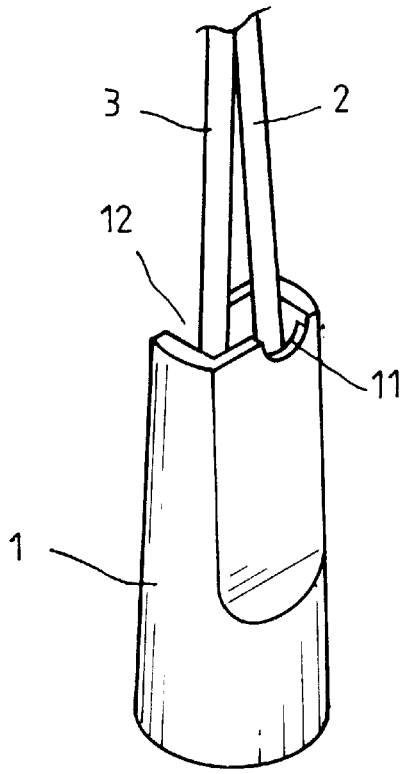
FIG. 2 is a perspective view showing the light bulb socket of FIG. 1 in association with electrical wires.
Figure 3:
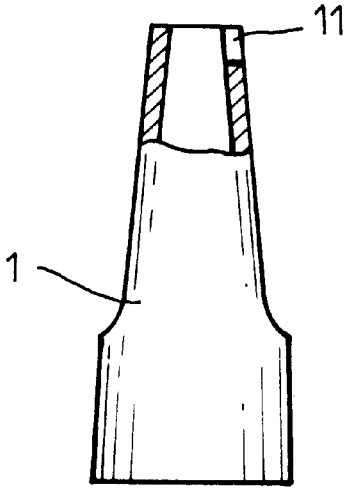
FIG. 3 is a partial cross sectional view of the socket of FIG. 1.
Figure 4:
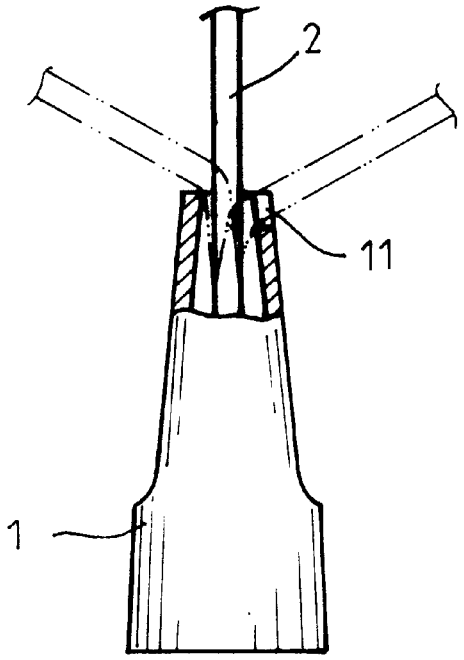
FIG. 4 shows the practice of the light bulb socket of FIG. 1.

Referring to FIGS. 1 through 4, the invention is featured by the improvements made on a light bulb socket (1), which primarily consist of two semi-circular grooves (11, 12) formed on two side walls and arranged in such a zigzag way that two electrical wires (2, 3) connecting to the light bulb seated in the socket are separately juxtaposed with one of two grooves. With such an arrangement, when the electrical wires (2, 3) bow to two sides the deflection points will be at different levels as shown in FIG. 4. Therefore the socket of the invention can effectively reduce the rupture of electrical connecting wires and elongate the service life of a light bulb socket.

Figure 5:
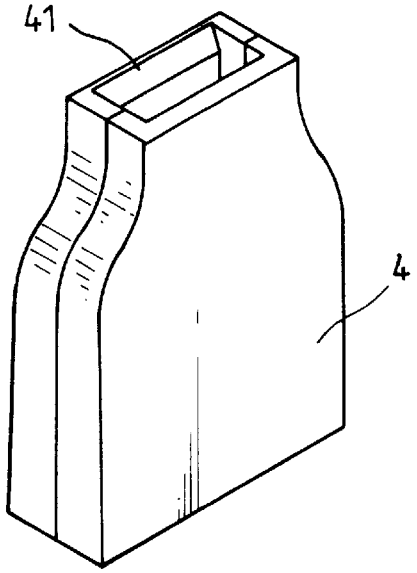
FIG. 5 illustrates another embodiment of a light bulb socket according to the invention.
Figure 6:
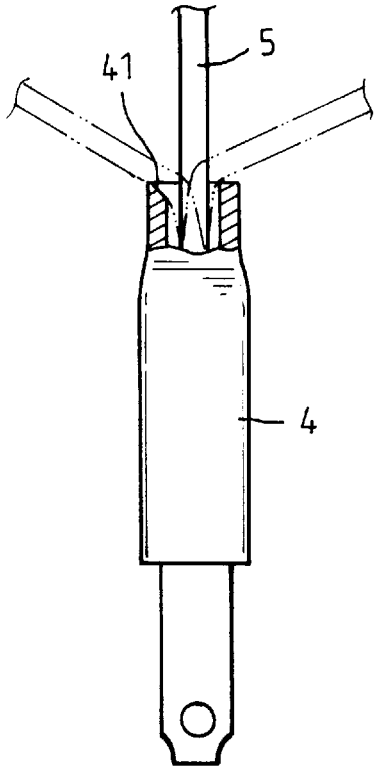
FIG. 6 illustrates the application practice of the light bulb socket shown in FIG. 5.

Now another embodiment of a socket structure according to the invention will be described with reference to FIGS. 5 and 6. As can be seen from the drawings, the principles of the invention can also be applied to other attachment parts, such as an electrical plug shown in FIG. 4. The plug (4) is provided with such an internal surface (41) on one side wall thereof that when electrical connecting wires (5) bow towards two sides the points supporting against the pressure from the side walls exerted on the wires will not be at the same levels. Consequently the electrical wires can avoid rupturing.

As described above, the invention obviously can obtain the object of preventing electrical connecting wires from being broken and prolonging the service life of a light bulb series.

What is claimed is:

1. A lightbulb socket for a miniature type lamp comprising a tubular socket member and a pair of electrical leads extending from one end of said socket member and being bent to extend laterally in opposite directions, said one end of said socket member having a pair of grooves respectively formed in opposing sides thereof in nonaligned relationship for respectively receiving said electrical leads therein.

* * * * *